US005206892A

United States Patent [19]

Guerin et al.

[11] Patent Number: 5,206,892

[45] Date of Patent: Apr. 27, 1993

[54] DEVICE FOR THE SHIELDING OF A MOTOR STATOR FOR THE ROTATING ANODE OF AN X-RAY TUBE

[75] Inventors: Christine Guerin, Issy les Moulineaux; Jacques Le Guen, Paris; Bernard Pouzergues, Villemoisson sur Orge, all of France

[73] Assignee: General Electric CGR S.A., Issy les Moulineaux, France

[21] Appl. No.: 869,445

[22] Filed: Apr. 16, 1992

[30] Foreign Application Priority Data

Apr. 17, 1991 [FR] France ..... 91 04734

[51] Int. Cl.[5] ..... H01J 35/16

[52] U.S. Cl. ..... 378/131; 378/125

[58] Field of Search ..... 378/131, 121, 125, 139, 378/142, 199-203

[56] References Cited

U.S. PATENT DOCUMENTS 2,703,373 3/1955 Cummings .
2,890,358 6/1959 Cummings ..... 378/131
4,161,655 7/1979 Cotic et al. ..... 378/19
4,225,787 9/1980 Shapiro et al. ..... 378/131
4,995,065 2/1991 Janouin et al. .
5,008,916 4/1991 Le Guen .

FOREIGN PATENT DOCUMENTS 0151878 8/1985 European Pat. Off. .
2094057 9/1982 United Kingdom .

*Primary Examiner*—David P. Porta
*Attorney, Agent, or Firm*—Pollock, VandeSande & Priddy

[57] ABSTRACT

In X-ray tubes with a rotating anode, the shielding of the stator is obtained by a first conductive layer that is deposited on the external wall of an insulating bell-shaped part and has an electrical discontinuity, and by a second conductive layer that is deposited on the internal wall of an insulating cup-shaped or bowl-shaped part, the bell and the bowl encasing the stator and thus creating an electrostatic screen against the high frequency oscillations that result from the "crackling" of the tube. The device can be applied to X-ray tubes for radiology instruments.

7 Claims, 2 Drawing Sheets

DEVICE FOR THE SHIELDING OF A MOTOR STATOR FOR THE ROTATING ANODE OF AN X-RAY TUBE

BACKGROUND OF THE INVENTION

1. Field of the Invention

The invention relates to X-ray tubes with rotating anodes and, more particularly, to a device for the shielding of the stator of the drive motor of the rotating anode.

An X-ray tube for medical diagnosis is generally constituted (FIG. 1) like a diode, i.e. with a cathode 11 and an anode 12 or anti-cathode, these two electrodes being enclosed in a vacuum-tight casing 14 that provides for the electrical insulation between these two electrodes. The cathode 11 produces a beam 13 of electrons and the anode receives these electrons on a small area that constitutes a focal spot from which the X-rays are emitted.

When the high supply voltage is applied by a generator 15 to the terminals of the cathode 11 and of the anode 12 so that the cathode is at the negative potential −HT, a current known as an electron current is set up in the circuit through the generator 15 producing the high voltage. The electron current goes through the space between the cathode and the anode in the form of the beam 13 of electrons which impinge onto the focal spot.

A small proportion of the energy used to produce the electron beam 13 is converted into X-rays, the rest of this energy being converted into heat. Hence, in view also of the high instantaneous power (in the range of 100 KW) brought into play, manufacturers have long been making X-ray tubes with rotating anodes where the anode is made to rotate in order to distribute the heat flux on a ring called a focal ring, with an area far greater than that of the focal spot. The value of this approach increases concomitantly with the rise in rotational speed (generally between 3,000 and 12,000 rpm).

The standard type of rotating anode has the general shape of a disk with an axis of symmetry 16 about which it is made to rotate by means of an electrical motor 17; the electrical motor has a stator 18 located outside the casing 14 and a rotor i 9 mounted in the casing 14 of the X-ray tube and positioned along the axis of symmetry 16, the rotor being mechanically fixed to the anode by means of a supporting shaft 20.

Owing the high levels of energy dissipation, the X-ray tube gets heated and it has to be cooled by being placed in a chamber, called a housing, in which there flows a cooling and insulating fluid that can be cooled by an appropriate device. This housing, made of a metal lined internally with a layer of lead, is also used to protect the external environment against the X-rays emitted by the focal spot of the X-ray tube in every direction.

The combination of the housing and of the tube then forms what is called an X-ray unit.

In an X-ray unit, the X-ray tube, unlike so-called passive components such as resistors, inductors and capacitors which behave according to established laws, is an active or reactive type of component that generates random disturbances against which protection must be provided.

For, the X-ray tubes that are used in medical X-ray diagnosis are vacuum tubes that work at very high voltages going up to 150 kilovolts. These high voltages prompt very strong electrical fields in the vacuum. These strong electrical fields are intensified by the presence of impurities or micro-aggregates on the surface of the electrodes which it is difficult to eliminate during the manufacture of the tube despite all the care with which the surface treatment operations are carried out. If the intensity of the electrical field becomes high enough, then an instability known as a "tube reaction" or "tube crackling" appears, and vaporises all or a part of the impurity that has caused this high intensity of the electrical field. If the surface, in its new state, is not homogeneous enough to reduce the localized intensity of the electrical field to a lower value, then the "crackling" is repeated until the surface is sufficiently homogeneous or "clean" to stand the high voltage.

This phenomenon appears from time to time throughout the life of the tube, and is the means by which the X-ray tube cleanses itself of the impurities that may shift randomly during the life of the tube.

These electrical discharges in the tube excite the natural resonances of the electrical circuits within the housing and the high frequency oscillations that result therefrom, which are typically in the range of a hundred megahertz, leak out and get radiated throughout the electronic equipment placed in the vicinity of the X-ray tube. These oscillations are often very high power oscillations and may, in that case, cause permanent damage to the sensitive electronic components, thus leading to malfunctioning of the electronic equipment.

2. Description of the Prior Art

The conventional means used to reduce the "tube crackling" effect on the electronic equipment are aimed at preventing high frequency parasites from entering the electronic equipment by enclosing the equipment in metal casings, placing filters at the inputs of the equipment and grounding the different elements of the equipment.

Furthermore, since the X-ray tube and the high-voltage generator are positioned in metal casings, the only elements that are not protected are the supply conductors of the cathode and of the anode, as well as those of the stator.

A known way of protecting the supply conductors of the cathode and of the anode is to use coaxial cables of a special type, comprising an external shielding ground-connected to the metal casing of the housing.

Another known method of in reducing the propagation of the high frequency oscillations for the wire of the stator consists of the series connection of inductors to said supply wires and the parallel connection of capacitors between the latter and the ground. Furthermore, to protect the stator itself, there is a known way of placing metal screens which are positioned, outside the tube, between the rotor and the stator. These metal screens are costly. Their mechanical fastening is difficult for the process of mounting them may cause deterioration to the wires of the stator. Their shapes should be rounded to prevent field effects between the stator and the anode. Their thickness of some tenths of a millimeter causes losses of driving currents and creates a heat screen limiting the heat dissipation of the stator.

SUMMARY OF THE INVENTION

The present invention is therefore aimed at making screens for the shielding of the stator that do not have the above-stated drawbacks.

The invention pertains, in an X-ray tube with rotating anode, to a device for the shielding of a stator of a driving motor of the rotating anode borne by the rotor of said motor, wherein said device comprises at least one metal film interposed between the rotor and the stator outside said tube.

In a first variant, the film is deposited on the external wall of an insulating bell-shaped part positioned between the wall of the tube and the stator.

In this variant, the film may also be deposited on the internal wall of an insulating cup-shaped or bowl-shaped part encasing the stator.

In a second variant, the metal film is deposited directly on the magnetic circuit and the associated coil.

In both variants, the metal film has an electrical discontinuity o the rotor side.

BRIEF DESCRIPTION OF THE DRAWINGS

Other objects, features and advantages of the present invention shall appear from the following description of a particular exemplary embodiment, said description being made with reference to the appended drawings, of which.

MORE DETAILED DESCRIPTION

Figure 1:
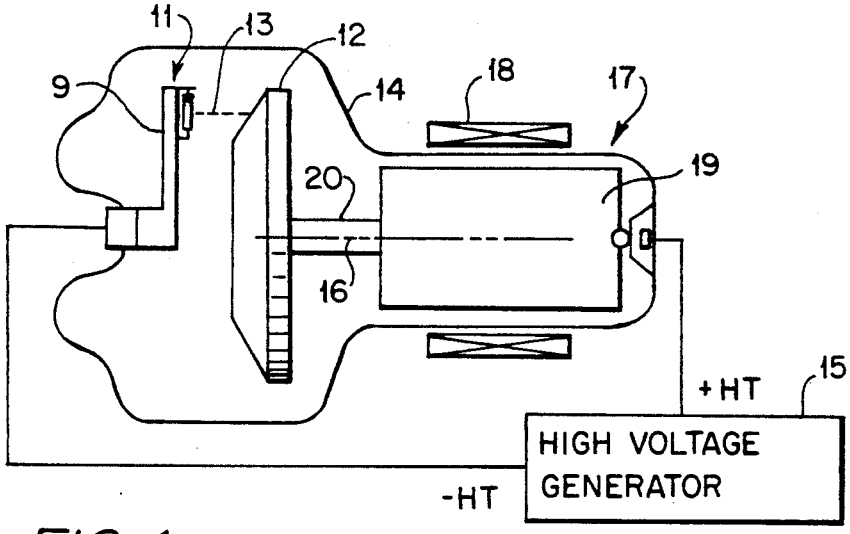
FIG. 1 is a schematic view of an X-ray tube.
Figure 2:
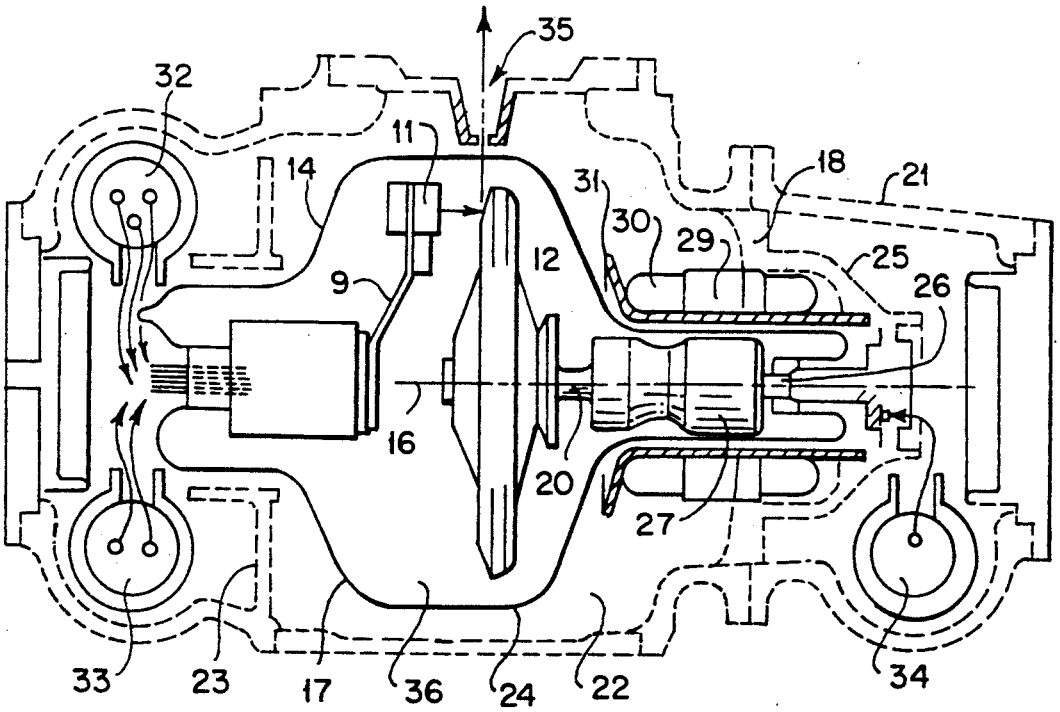
FIG. 2 is a detailed view of an X-ray tube with rotating anode positioned in a protection and cooling housing.

An X-ray tube (FIG. 2), of the type described in the preamble with reference to FIG. 1, is positioned in a closed metal chamber or housing 21 filled with an insulating and cooling fluid 22. The X-ray tube 24 is kept in position in this housing by an insulating flange 23, fixedly joined to the housing 21, which grips the casing 14 of the tube and by an insulating support 25 fixedly joined to the housing 21, on which there lies an end 26 of a rotor 27 located within the casing 14.

The bowl-shaped insulating support 25 is also used as a support for a stator 28 positioned within the bowl, said stator comprising a magnetic circuit 29 and a coil 30.

An insulating bell-shaped part 31 is interposed between the stator 28 and the rotor 27, outside the casing 14, and is fixed to the insulating bowl-shaped support 25.

The supply conductors of the different elements of the cathode 11 come from the generator 15 by means of connections that get plugged into receptacles 32 and 33 crossing the wall of the housing 21. Similarly, the supply conductor of the anode comes from said generator 15 by means of a connector that gets plugged into a receptacle 34 crossing the wall of the housing 21.

Furthermore, the housing 21 is fitted out in a standard way with a window 35 for the output of the X-ray beam.

Figure 3:
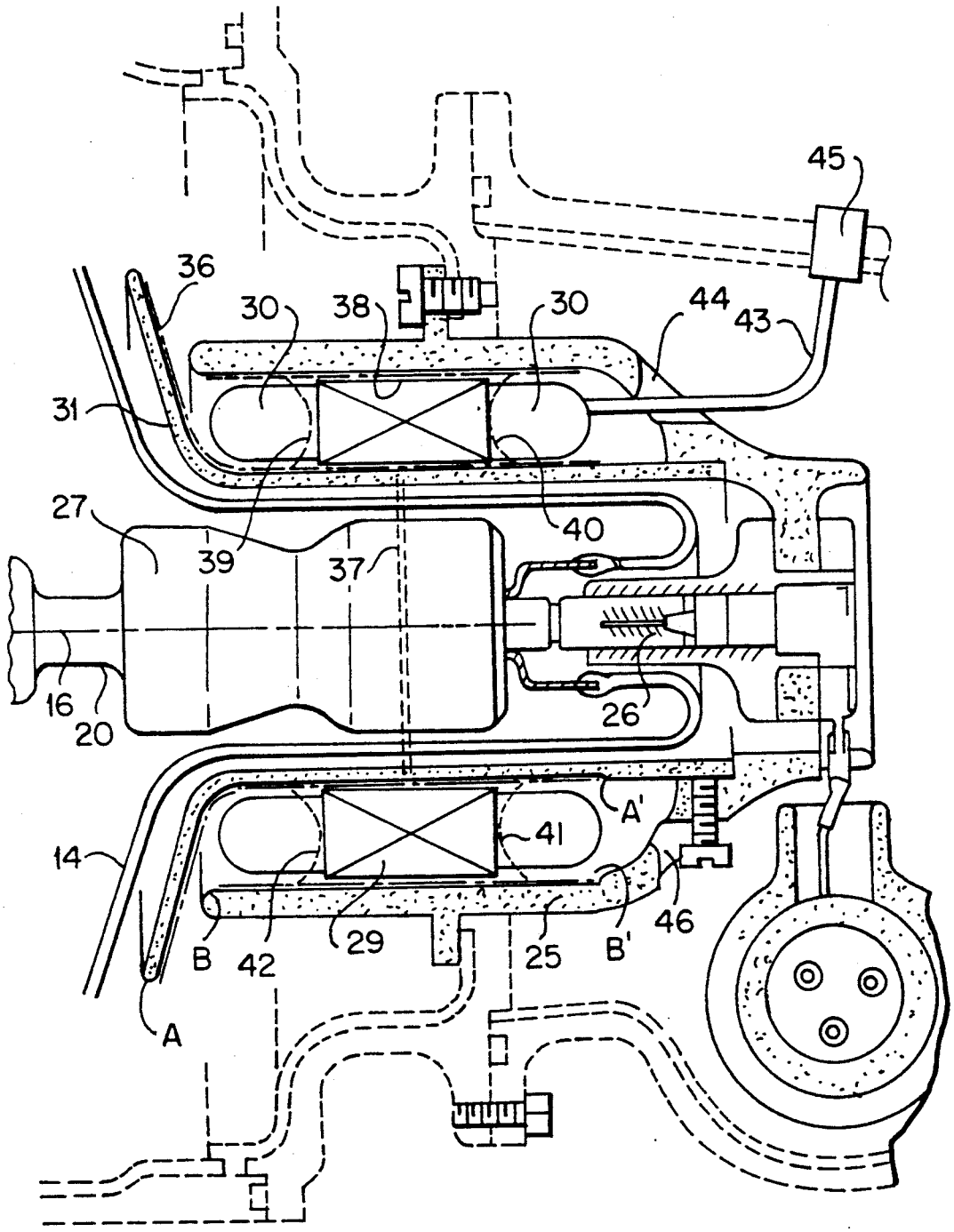
FIG. 3 shows an enlarged and detailed view of the stator and of the rotor of the driving motor of the anode, showing the additional protection means according to the invention.

According to a first aspect of the invention (FIG. 3), the external part of the bell-shaped part 31 is coated with a conductive layer 36 on an area between the points A and A', said conductive layer having a circular discontinuity 37 that is made at mid-height on the magnetic circuit 29. This discontinuity is designed to prevent currents from being induced in the conductive layer instead of in the rotor. The distance AA' is such that the layer 36 forms an electrostatic screen between the anode and the stator or between the rotor and the stator.

According to a second aspect of the invention, the edges of the bowl-shaped support 25 are extended so as to completely encase the stator 18 and the internal wall of the bowl-shaped support 25 is coated with a conductive layer 38 on an area between the points B and B' that surrounds the entire stator 18.

For the shielding formed by the conductive layers 36 and 38 to be efficient, these layers are ground-connected to the housing 21 by low impedance means, for example the soldering of ground conductors on the layers, or flexible contacts made of bronze-beryllium, referenced 39, 40, 41 and 42.

The coil 30 is supplied by conductors in a cable 43 that crosses the bowl-shaped support 25 by a hole 44 and the housing by an imperviously sealed passage 45.

Besides, the bowl-shaped support 25 has holes 46 for the circulation of the fluid 22.

According to another variant of the invention, the electrostatic screen is formed by a metal film that is applied to the coil 30, the cable 43 as well as the magnetic circuit 29, and the active wires that it encloses in its grooves. Naturally, the conductive parts 29, 30 and 43 will be insulated beforehand by an enamel or insulator material so as to prevent short-circuits between the conductors of the coil and the plates of the magnetic circuit.

In this variant, there is also provision for an electrical discontinuity of the metal film on the rotor side and its grounding. Finally, this metal film will have a few holes on the housing wall side to enable the passage of the gas bubbles.

The material of the layer or of the metal film may be copper, silver or any other material that is a good conductor of electricity, and its thickness may range from some microns to some tenths of a millimeter.

The invention has been described (FIG. 3) in showing a conductive layer 36 on the external wall of the bell-shaped part 31 and a conductive layer on the internal wall of the bowl-shaped support 25. However, the invention can be implemented with a conductive layer on the external wall of the bowl-shaped support 25.

What is claimed is:

1. A device for the shielding, in an X-ray tube with rotating anode, of a stator, having a magnetic circuit and coil, of a driving motor of the rotating anode borne by the rotor of said motor, wherein said device comprises at least one metal film that encases the stator and is interposed between, firstly, said stator and, secondly, the anode and the rotor.

2. A shielding device according to claim 1, wherein the metal film is deposited on the external wall of an insulating bell-shaped part positioned outside the tube between the rotor and the stator.

3. A shielding device according to claim 1, wherein the metal film is deposited on the magnetic circuit and on the coil of the stator.

4. A shielding device according to claim 2, wherein the metal film is furthermore deposited on the internal wall of an insulating bowl-shaped support positioned outside the stator.

5. A shielding device according to claim 2, wherein the metal film is furthermore deposited on the external wall of an insulating bowl-shaped support positioned outside the stator.

6. A shielding device according to claim 1, wherein the metal film has an electrical discontinuity in the area located between the rotor and the stator.

7. A shielding device according to claim 1, wherein the metal film covers a supply cable of the coil of the stator.

* * * * *

UNITED STATES PATENT AND TRADEMARK OFFICE

CERTIFICATE OF CORRECTION

PATENT NO. : 5,206,892

DATED : April 27, 1993

INVENTOR(S) : Christine Guerin, et al.

It is certified that error appears in the above-identified patent and that said Letters Patent is hereby corrected as shown below:

Column 1, line 45, change "i9" to --19--.

Column 2, line 49, change "wire" to --wires--.

Column 3, line 16, change "o" to --on--.

Signed and Sealed this

Twenty-eighth Day of December, 1993

*Attest:*

Bruce Lehman

BRUCE LEHMAN

*Attesting Officer*

*Commissioner of Patents and Trademarks*